US010065107B2

(12) United States Patent
Lee et al.

(10) Patent No.: US 10,065,107 B2
(45) Date of Patent: Sep. 4, 2018

(54) CONSTRAINED PUZZLE

(71) Applicant: Micro UV Technologies, LLC, Huntington Beach, CA (US)

(72) Inventors: Cindy Lee, Huntington Beach, CA (US); Kang Lee, Huntington Beach, CA (US)

(73) Assignee: MICRO UV TECHNOLOGIES, LLC, Huntington Beach, CA (US)

( * ) Notice: Subject to any disclaimer, the term of this patent is extended or adjusted under 35 U.S.C. 154(b) by 0 days.

(21) Appl. No.: 15/649,582

(22) Filed: Jul. 13, 2017

(65) Prior Publication Data

US 2018/0015361 A1 Jan. 18, 2018

Related U.S. Application Data

(60) Provisional application No. 62/361,848, filed on Jul. 13, 2016.

(51) Int. Cl.
*A63F 9/08* (2006.01)
*A63F 9/06* (2006.01)

(52) U.S. Cl.
CPC ..... *A63F 9/0865* (2013.01); *A63F 9/0602* (2013.01); *A63F 9/0604* (2013.01)

(58) Field of Classification Search
CPC ..... A63F 9/06; A63F 9/0602; A63F 9/0604; A63F 9/08; A63F 9/0826; A63F 9/0857; A63F 9/0865
See application file for complete search history.

(56) References Cited

U.S. PATENT DOCUMENTS 4,553,754 A * 11/1985 Wiggs ..... A63F 9/0857 273/153 S
4,557,484 A 12/1985 Sherman
4,708,345 A * 11/1987 Ayers ..... A63F 9/0869 273/153 S
4,865,324 A 9/1989 Nesis
4,881,738 A * 11/1989 Ayers ..... A63F 9/0869 273/153 S
5,172,912 A * 12/1992 Lammertink ..... A63F 9/0807 273/113

(Continued)

FOREIGN PATENT DOCUMENTS

EP 1690573 5/2008

*Primary Examiner* — Steven Wong
(74) *Attorney, Agent, or Firm* — Sheppard, Mullin, Richter & Hampton LLP; Daniel Yannuzzi

(57) ABSTRACT

A constrained puzzle device including a housing formed with a radial crescent gutter; one or more slots providing an opening from an outer edge of the housing toward a centerline of the housing; a cartridge wheel nested within the slot and rotatably coupled to the housing, the cartridge wheel having multiple channels passing therethrough. The constrained puzzle device further includes one or more dials rotatably coupled with the housing, the dials configured with structures extending at least partially over the crescent gutter to create one or more pocket regions. Puzzle objects can be disposed within a channel of the cartridge wheel and the slot of the housing, or within the crescent gutter of the housing and a pocket formed by at least one arm member of the dial. The puzzle objects can be moved around in the constrained puzzle device as a user rotates the dials and/or the cartridge wheels.

11 Claims, 11 Drawing Sheets

(56) References Cited

U.S. PATENT DOCUMENTS

| | | | | | |
|---|---|---|---|---|---|
| 5,301,943 | A * | 4/1994 | Asztalos | A63F 9/0869 | 273/113 |
| 5,358,247 | A | 10/1994 | Meffert | | |
| 5,370,394 | A * | 12/1994 | Huncaga | A63F 9/0838 | 273/153 S |
| 5,628,512 | A * | 5/1997 | Chan | A63F 9/0826 | 273/153 S |
| 5,645,278 | A * | 7/1997 | Harris | A63F 9/0857 | 273/153 S |
| 5,788,232 | A | 8/1998 | Binkley | | |
| 5,816,571 | A | 10/1998 | Chen | | |
| 5,836,584 | A | 11/1998 | Chen | | |
| 5,957,453 | A | 9/1999 | Binkley | | |
| 6,003,868 | A * | 12/1999 | Unsicker | A63F 9/0838 | 273/153 S |
| 6,386,540 | B1 * | 5/2002 | Stevkovski | A63F 9/0834 | 273/153 S |
| 6,769,690 | B1 | 8/2004 | Khoudary | | |
| 6,883,802 | B2 * | 4/2005 | Rom | A63F 9/0819 | 273/153 S |
| 7,168,703 | B2 | 1/2007 | Lammertink | | |
| 8,109,515 | B2 | 2/2012 | Fedoseyev et al. | | |
| 8,360,432 | B2 | 1/2013 | Hjerppe | | |
| 2010/0264583 | A1 | 10/2010 | Hjerppe | | |
| 2014/0217671 | A1 * | 8/2014 | Mayants | A63F 9/0857 | 273/153 S |

* cited by examiner

CONSTRAINED PUZZLE

TECHNICAL FIELD

The present disclosure relates generally to puzzle gaming devices, and some embodiments relate more particularly to handheld puzzle devices with one or more parts that are movable relative to one another but subject to one or more movement constraints.

BRIEF SUMMARY OF THE DISCLOSURE

The present disclosure is directed toward handheld puzzle gaming technologies. Some embodiments of constrained puzzle systems, apparatus, and/or devices of the present disclosure may include: one or more of a substantially toroid-shaped housing configured with one or more slot(s) proceeding inward from an outer edge of the housing, and/or configured with one or more gutter(s) proceeding in a radial path along one or more side surfaces of the housing; one or more cartridge wheel(s) rotatably coupled to the housing and situated at least partially within one or more slot(s) of the housing; one or more puzzle object(s) configured to fit at least partially within, and, in some instances, pass all the way through (in at least one but not all directions) one or more channel(s) of the cartridge wheel(s); and/or one or more puzzle object keyed dial(s) rotatably coupled with the housing and forming one or more pocket region(s) between the gutter of the housing and the structure of an object keyed dial. In operation, cartridge wheel(s) and/or puzzle object keyed dial(s) may be rotated in one or more directions relative to the housing, and with their rotation move one or more puzzle object(s) into different locations throughout or relative to the structure of the constrained puzzle device (e.g. from one pocket region to another, from one cartridge wheel to another, from a channel of a cartridge wheel to a pocket region formed entirely outside a cartridge wheel channel, etc.).

In some embodiments, the constrained puzzle device includes a housing, the housing configured with: a crescent gutter along a radial path of a side of the housing, the crescent gutter having a radius of curvature; and a slot providing an opening from an outer edge of the housing toward a centerline of the housing. Some such embodiments may further include a cartridge wheel at least partially disposed within the slot and rotatably coupled to the housing, the cartridge wheel configured with multiple channels having a radius of curvature. Some such embodiments may further include a dial rotatably coupled with the housing, the dial configured with multiple arm members extending at least partially over the crescent gutter of the housing. Some such embodiments may further include multiple puzzle objects, at least one of the multiple puzzle objects disposed within a channel of the cartridge wheel and the slot of the housing, and at least one of the multiple puzzle objects disposed within the crescent gutter of the housing and a pocket formed by at least one arm member of the dial.

In some embodiments, when the cartridge wheel is in a first position, at least one of the multiple puzzle objects may be movable out of a channel of the cartridge wheel and along the radial path of the crescent gutter as the dial is rotated. In some embodiments, wherein when a cartridge wheel is in a first position, the radius of curvature of at least one channel of the cartridge wheel substantially aligns with the radius of curvature of the crescent gutter.

In some embodiments, the multiple puzzle objects are spherical. And in some embodiments, the radius of the multiple puzzle objects is less than or equal to the radius of curvature of the crescent gutter.

In some embodiments, one or more of the housing and the cartridge wheel include guide elements to move the cartridge wheel into one of multiple preferred positions relative to the housing. Likewise, in some embodiments one or more of the housing and the dial include guide elements to move the dial into one of multiple preferred positions relative to the housing.

In some embodiments, the multiple puzzle objects are labeled with numbers. In some embodiments, the multiple puzzle objects are not all the same color.

In some embodiments, the constrained puzzle device includes a housing, the housing being configured with a first crescent gutter along a radial path of a first side of the housing, and a second crescent gutter along a radial path of a second side of the housing. The second side of the housing opposite the first side of the housing, the first crescent gutter and the second crescent gutter having substantially equal radii of curvature. In some embodiments the housing is configured with multiple slots, the slots providing a radially inward openings from an outer edge of the housing. Some such embodiments may further include multiple cartridge wheels, the cartridge wheels at least partially disposed within the slots and rotatably coupled to the housing. The cartridge wheels can be configured with multiple channels, the channels having substantially equal radii of curvature.

Some such embodiments may further include a first dial rotatably coupled with the housing, the first dial configured with one or more members extending at least partially over the first crescent gutter. Some such embodiments may further include a second dial rotatably coupled with the housing, the second dial configured with one or more members extending at least partially over the second crescent gutter.

Some such embodiments may further include multiple puzzle objects, at least one of the multiple puzzle objects disposed at least partially within one or more of: a channel of a cartridge wheel, a slot of the housing, the first crescent gutter of the housing, and the second crescent gutter of the housing. In some embodiments, the radius of the puzzle objects is less than or equal to the radii of curvature of the first crescent gutter and the second crescent gutter.

In some embodiments, when the cartridge wheels are aligned in a first preferred position, one or more puzzle objects may be movable out of one or more cartridge wheel channels and along the path of the first crescent gutter as the first dial is moved. And in some embodiments, when the cartridge wheels are aligned in the first preferred position, one or more puzzle objects may be movable out of one or more cartridge wheel channels and along the path of the second crescent gutter as the second dial is moved. In some embodiments, the first dial is rotatable independent of any rotation of the second dial.

In some embodiments, one or more of the housing and the cartridge wheels include guide elements to move the cartridge wheels into one of multiple preferred positions relative to the housing. And in some embodiments, one or more of the housing and the first dial include guide elements to move the first dial into one of multiple preferred positions relative to the housing. And in some embodiments, one or more of the housing and the second dial include guide elements to move the second dial into one of multiple preferred positions relative to the housing.

In some embodiments, the multiple puzzle objects are spherical. In some embodiments, the multiple puzzle objects are labeled with numbers. And in still further embodiments the multiple puzzle objects are not all the same color.

BRIEF DESCRIPTION OF THE FIGURES

The technology disclosed herein, in accordance with one or more embodiments, is described in detail with reference to the following figures. These figures are provided to facilitate the reader's understanding of the disclosed technology, and are not intended to be exhaustive or to limit the disclosure to the precise forms disclosed. Indeed, the drawings in the figures are provided for purposes of illustration only, and merely depict typical or example embodiments of the disclosed technology. Furthermore, it should be noted that for clarity and ease of illustration, the elements in the figures have not necessarily been drawn to scale.

It is noted at the outset that numerals in the figures often point only to representative elements/features (e.g. a representative object 300) instead of individually pointing to all such similar elements/features in the particular embodiment shown. This is not intended to limit, and should not be construed as limiting, the corresponding discussion to the single element/feature pointed to in the figure. Instead, it should be understood that the discussion of a given element pointed out in a given figure may relate to any and all such similar elements in the given figure or another figure, even where the numerals in the given figure under discussion only points to one such element (e.g. a representative element).

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION

The present disclosure is directed toward handheld puzzle gaming technologies. Some particular embodiments of constrained puzzle systems, apparatus, and/or devices of the present disclosure may include: one or more of a housing (in some embodiments a substantially toroid-shaped housing) configured with one or more slot(s) proceeding inward from an outer edge of the housing, and/or configured with one or more gutter(s) proceeding in a radial path along one or more side surfaces of housing; one or more cartridge wheel(s) rotatably coupled to housing and situated at least partially within one or more slot(s) of housing; one or more puzzle object(s) (sometimes referred to herein as simply "objects") configured to fit at least partially within, and, in some instances, pass all the way through (in at least one but not all directions) one or more channel(s) of the cartridge wheel(s); and/or one or more puzzle object keyed dial(s) (sometimes referred to herein as simply "dials") rotatably coupled with the housing and forming one or more pocket region(s) between the gutter of the housing structure and the structure of the dial(s). In operation, cartridge wheel(s) and/or puzzle object keyed dial(s) may be rotated in one or more directions relative to the housing, and with their rotation move one or more puzzle object(s) into different locations throughout or relative to the structure of the constrained puzzle device (e.g. from one pocket region to another, from one cartridge wheel to another, from a channel of a cartridge wheel to a pocket region formed entirely outside a cartridge wheel channel, etc.).

Figure 1:
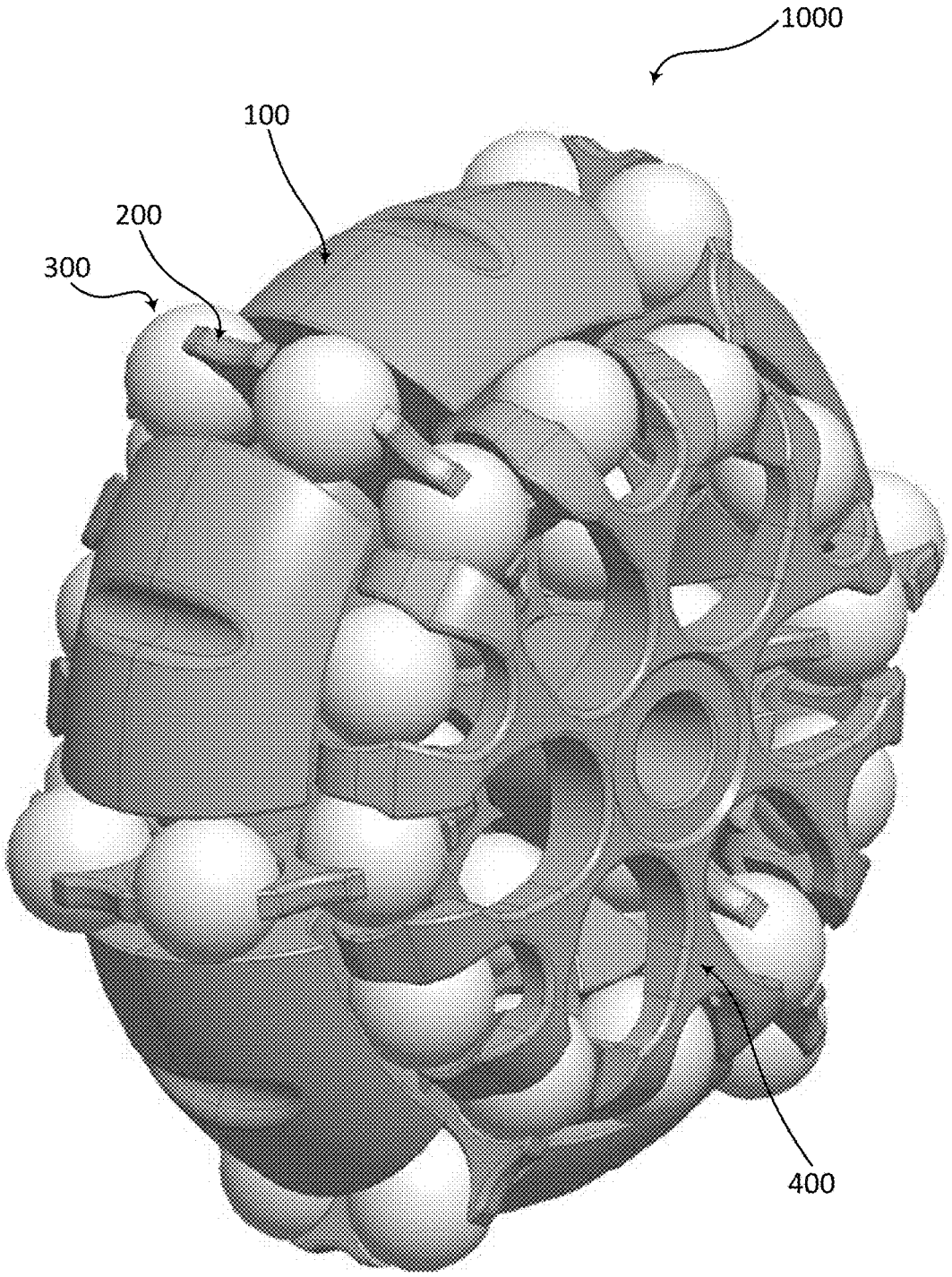
FIG. 1 illustrates a perspective view of constrained puzzle device in accordance with one or more embodiments of the present disclosure.

FIG. 1 illustrates a perspective view of constrained puzzle device (CPD) 1000 in accordance with some embodiments of the present disclosure. As depicted, CPD 1000 includes a housing 100 configured with a plurality of slots (e.g. six slots) proceeding radially inward from the outer edge of the housing 100 toward the center; a plurality of cartridge wheels 200 (e.g. six cartridge wheels) having one or more channel (e.g. holes, cutouts, flutes, passageways, openings etc.) and being rotatably coupled to housing 100, situated at least partially within one of the aforementioned slots of housing 100; a plurality of puzzle objects 300 (e.g. spherical balls) configured to fit within and pass through one or more of the channel(s) formed in cartridge wheel(s) 200 (but being constrained from moving in the radial outward direction relative to the cartridge wheel when situated within such channel(s)). As shown, some embodiments may also include a plurality of dials 400 (e.g. two dials on opposite sides of the housing) rotatably coupled with housing 100 and forming, in part, a plurality of pocket regions that may engage with and/or constrain the movement of the one or more object(s) 300. In some embodiments, as depicted, the plane of rotation of dial(s) 400 may be substantially orthogonal to the plane of rotation of cartridge wheel(s) 200.

As depicted, the various components that comprise CPD 1000 may be assembled and fashioned in a manner that forms one or more pockets and/or other apertures wherein one or more object(s) 300 may be held (e.g. loosely held). For example, viewing the exemplary embodiment depicted in FIG. 1, CPD 1000 may hold forty-eight object(s) 300—six objects 300 positioned within the channels of each of the six cartridge wheels 200 (and supported by the side walls of the slots in the housing), six more held between the housing (at least partially within a first crescent gutter that proceeds in an annular/radial path along and around a first side of housing 100) and the arms/spokes of a first dial 400, and six more held between the housing (at least partially within a second crescent gutter that proceeds in an annular/radial path along and around a second side of housing 100) and the arms/spokes of a second dial. In operation, as user rotates a cartridge wheel 200 and/or a dial 400 relative to housing 100, objects 300 may be made to move into different pocket regions and/or other locations throughout the CPD 1000. As shown in the exemplary embodiment in FIG. 1, rotating either, both, or any one or more of cartridge wheel(s) 200 and/or dial(s) 400 necessarily moves objects 300 into a different location within and/or throughout the CPD 1000. Further, although not required, rotating either, both, or any one or more of cartridge wheel(s) 200 and/or dial(s) 400 will necessarily move more than one object 300 at a time. Because multiple objects 300 may be made to move with each movement of either the cartridge wheel(s) 200 or the dial(s) 400, the CPD 1000 structural elements thereby present an obstacle a user must overcome to achieve certain arrangement(s) of the objects 300 (i.e. to solve the puzzle). In some embodiments, a user may solve the puzzle by achieving one or more predefined puzzle arrangements based on one or more of color, numbering, design, etc.

For example, objects 300 may be colored with eight different colors—six objects of each color—and the user may be charged with the task of rearranging an initially random arrangement of objects 300 throughout the CPD 1000 into an ordered arrangement where objects situated within each cartridge wheel 200 are objects of the same color. In another example, six sets of six objects 300 may be numbered 1 through 6, with twelve objects 300 being unnumbered (e.g. solid white, blank, or "wild," etc.). A user may be charged with the task of rearranging an initially disordered arrangement of objects 300 into an ordered arrangement where the objects 300 situated within each cartridge wheel 200 are objects of the same number (e.g., all 1s, all 2s, all 3s, all 4s, all 5s, or all 6s as one proceeds around the cartridge wheel(s) 200), or objects of consecutive number (e.g. ordered 1, 2, 3, 4, 5, 6 as one proceeds around the cartridge wheel(s) 200). In other examples, the objects may be marked in a more complicated manner—such as having both a number, a color, and/or a suite designation (such as seen in a deck of cards for example—e.g. clubs, spades, hearts, diamonds, etc.). The objectives may similarly be more or less complicated depending on the level of difficulty desired (e.g. an objective may be to arrange numbered objects in consecutive order within each cartridge wheel, where all the objects within each cartridge wheel are also of the same suite). One of ordinary skill in the art will appreciate that any object grouping and/or marking system may be employed, and any particular object arrangement may be predefined as the objective of the game. Moreover, one of ordinary skill in the art will also appreciate that any other alterations/modifications to other elements of CPD 1000 may be employed, adjusted, modified, etc. to enhance or reduce complexity.

For example, one simple embodiment may only include three cartridge wheels, each configured to hold just two or three object(s), and the objective may be to simply arrange the objects 300 such that each cartridge wheel only holds objects 300 of a single color. In another example, a more complex embodiment may include a dial 400 that, when rotated, moves more than one object out of each cartridge wheel 200 at a time (e.g. moving two or three out of the wheel at a time, for example).

Figure 2:
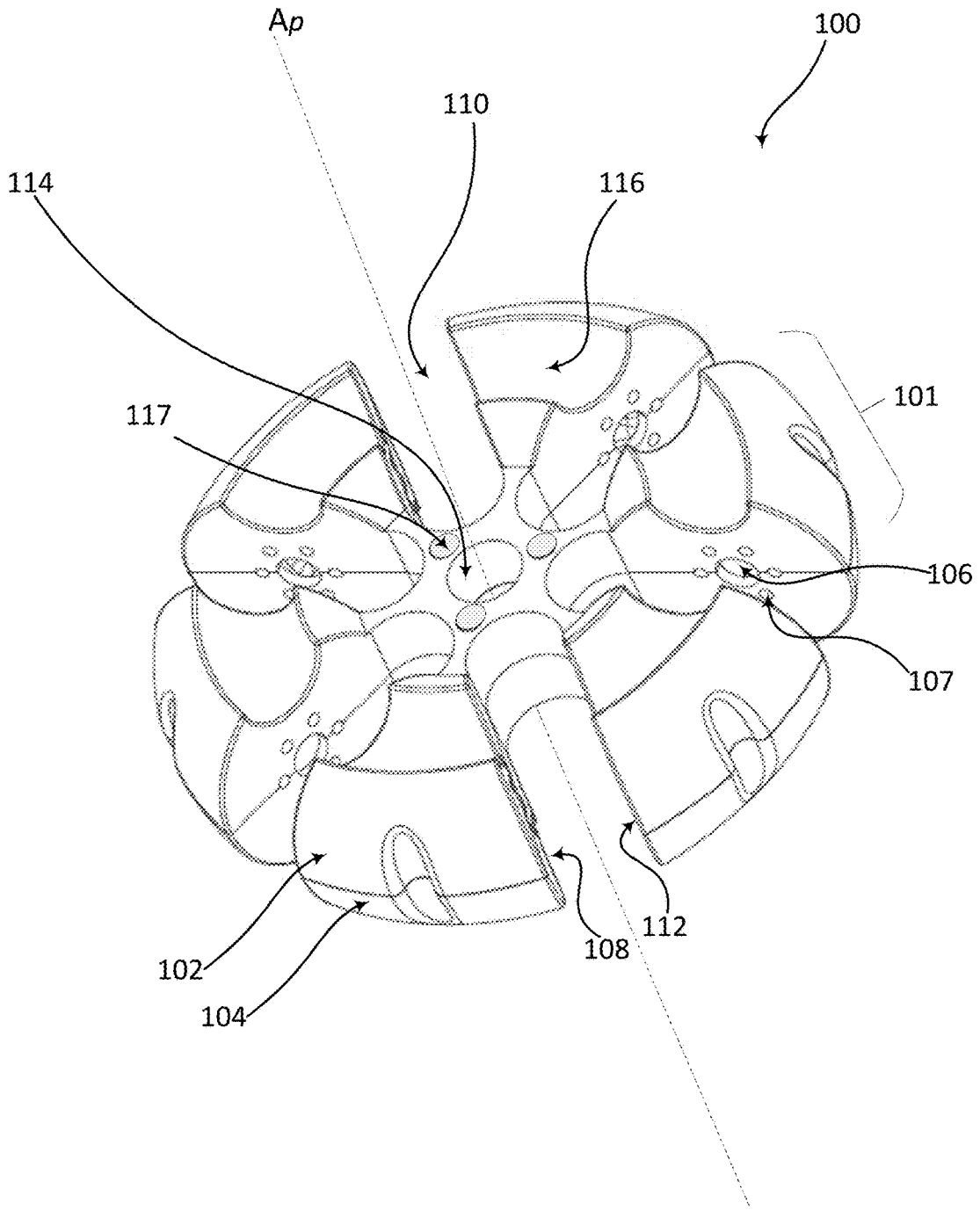
FIG. 2 illustrates a perspective view of an example housing component in accordance with some embodiments of the present disclosure, and in particular in accordance with the example embodiment shown in FIG. 1.

FIG. 2 illustrates an exemplary housing 100 component in accordance with some embodiments of the present disclosure, and in particular in accordance with the exemplary CPD shown in FIG. 1. For clarity and ease of understanding, the exemplary housing 100 illustrated in FIG. 1 is shown in FIG. 2 as separated from the remainder of the CPD 1000 assembly. As depicted, housing 100 may take on a substantially disc- or wheel-like shape (with the toroid-shaped outermost section discussed above). In some instances the housing 100 may be thought of as a slotted wheel with tapered spokes. As shown, housing 100 includes one or more slots 110 (e.g. six slots in the depicted embodiment) positioned radially (and, in some embodiments, equidistant) about housing 100 and proceeding inward from outer surface 101 inward toward housing 100's absolute center, located at the primary axis, Ap, depicted in FIG. 2. Also as depicted, one or more portions of outer surface 101 of housing 100 may be substantially rounded.

Further, one or more portions of housing 100's side surfaces may include a gutter 116 wherein a portion of an object 300 may be situated after having been moved out of a channel of a cartridge wheel 200 by a dial 400. In some embodiments, gutter 116 will have a crescent radius of curvature that (i) substantially matches (but is slightly larger than) the radius of curvature of a portion of object(s) 300, and/or (ii) substantially matches the radius of curvature of a portion of the channel traversing the thickness of cartridge wheel(s) 200. In other words, in some embodiments the housing 100 displays an annular crescent gutter 116 on each of its sides, the gutters 116 being configured such that a portion of object 300 may easily be nested/situated therein and movable along and within the gutter 116 (upon an applied force by the structure of dial 400 when it is made to rotate). Thus, the gutter 116 in some embodiments operates as a track for the object(s) 300.

As depicted in FIG. 2, housing 100 may be configured with one or more coupling features (e.g. counter-bored hole(s) 106, pass-through hole(s) 114, and the like) for rotatably coupling one or more cartridge wheel(s) 200 and/or dial(s) 400 therewith. In some embodiments, CPD 1000 may include, may form in part, or may be otherwise incorporate one or more guide elements (e.g. ball plungers, spring plungers, and the like). As depicted in FIG. 2, housing 100 may be configured with one or more apertures 117 structured to accommodate (or form, in part) one or more guide elements (e.g. ball plungers, spring plungers, and the like). Such guide elements (as explained in further detail, for example, in connection with FIGS. 3C-4C in the context of their application to cartridge wheel(s) 200) aid in the precise positioning of dial(s) 400 as it/they is made to rotate relative to housing 100.

Figure 3A:
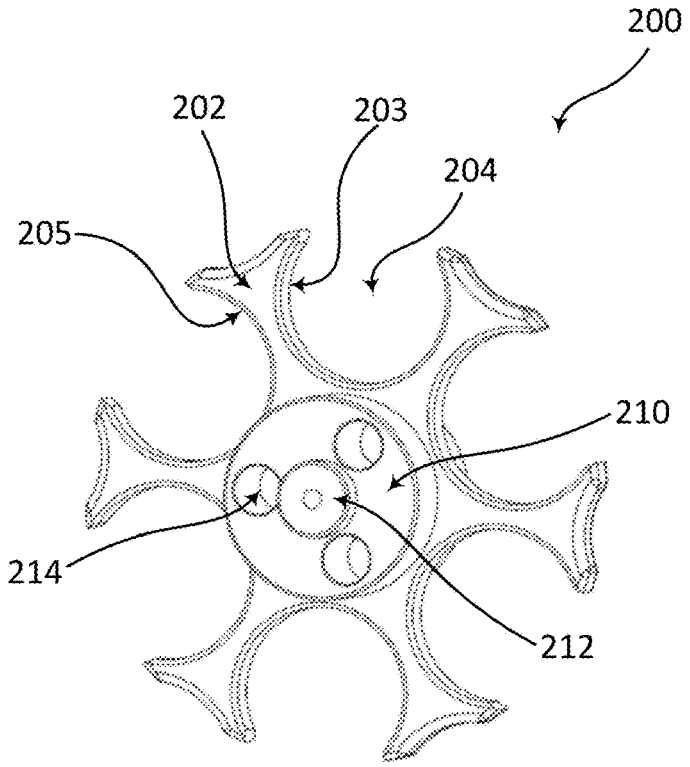
FIG. 3A illustrates a perspective view of an example cartridge wheel component in accordance with some embodiments of the present disclosure, and in particular in accordance with the example embodiment shown in FIG. 1.
Figure 3B:
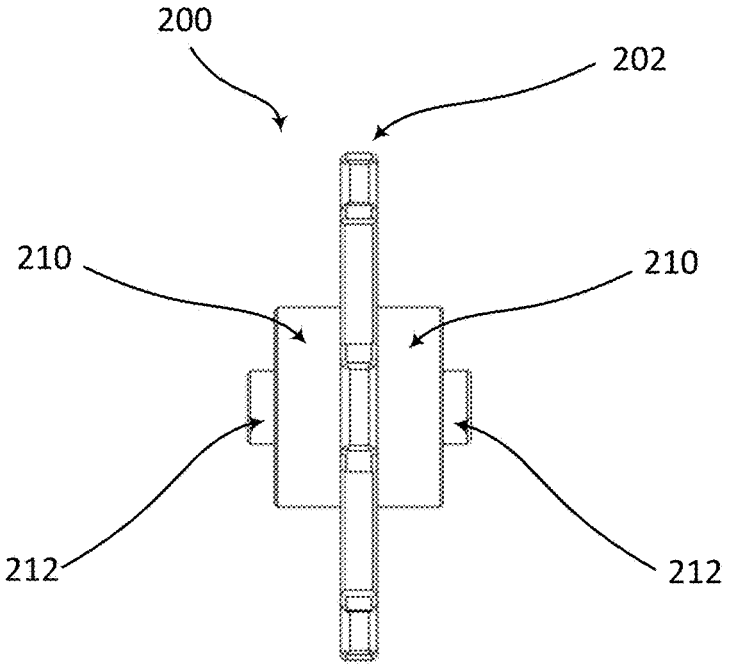
FIG. 3B illustrates another perspective view of an example cartridge wheel in accordance with some embodiments of the present disclosure, and in particular in accordance with the example embodiment shown in FIG. 1.

FIG. 3A is a perspective view of an exemplary cartridge wheel 200 in accordance with some embodiments of the present disclosure, and in particular in accordance with the exemplary CPD 1000 shown in FIG. 1. FIG. 3B is a different perspective view of the same cartridge wheel 200 depicted in FIG. 3A. As shown in FIGS. 3A-3B, and taken together with FIGS. 1-2, cartridge wheel 200 may be configured to be rotatably coupled with and partially disposed between one or more of side wall(s) 108, 112 (e.g. the walls defining slot(s) 110 in housing 100). As shown in FIG. 3A, cartridge wheel(s) 200 may be formed with or otherwise display a plurality of channels 204 (e.g. here, six open channels) that traverse the thickness dimension of the cartridge wheel 200 and are configured to permit object(s) 300 to pass therethrough in a direction substantially orthogonal to the radial plane of the wheel, but restrict object(s) 300 from passage in the outward radial direction(s). Such channel(s) 204 may be defined, in part, by one or more side walls 203, 205 of one or more of spoke(s) 202 of cartridge wheel(s) 200. In some embodiments, cartridge wheel(s) 200 may be configured with one or more complementary coupling mechanisms configured to engage with one or more of the coupling mechanisms of housing 100. For example, cartridge wheel(s) 200 may be configured with a spacer 210 extending from a central portion of cartridge wheel(s) 200 and/or an axle 212 extending outward from the spacer 210, the axle 212 configured to be fitted within a portion of counter-bored hole 106 of housing 100 (e.g. creating/providing a rotatable coupling mechanism).

Figure 3C:
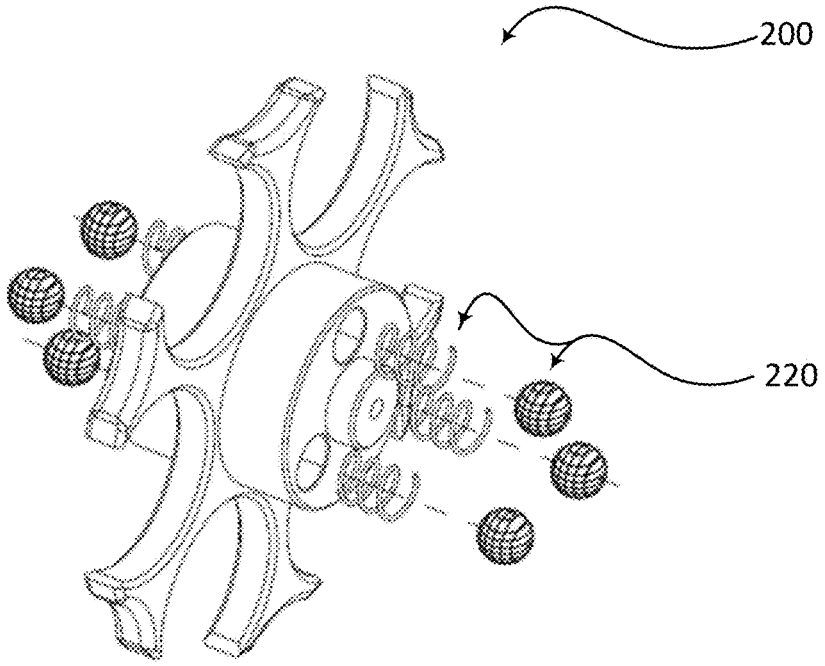
FIG. 3C illustrates another perspective view of an example cartridge wheel in accordance with some embodiments of the present disclosure, and in particular in accordance with the example embodiment shown in FIG. 1.

As further depicted in FIG. 3A, cartridge wheel(s) 200 may be configured with one or more apertures 214 structured to accommodate (or form, in part) one or more guide elements (e.g. such as ball plungers, spring plungers, and the like). FIG. 3C illustrates a perspective view of the cartridge wheel(s) 200 in FIG. 3A, further depicting guide elements that may employed in some embodiments of the present technology, and in particular in accordance with the exemplary CPD shown in FIG. 1. Guide elements 220 (which may include a simple ball plunger, including a spherical ball situated at one end of a spring, or any other guide element mechanism known in the art) may engage with complementary features in housing 100, e.g. divot(s) 107, to snap cartridge wheel(s) 200 into one or more preferred positions in the path of rotation. In some instances a CPD 1000 may have as many preferred positions as there are objects 300.

Figure 3D:
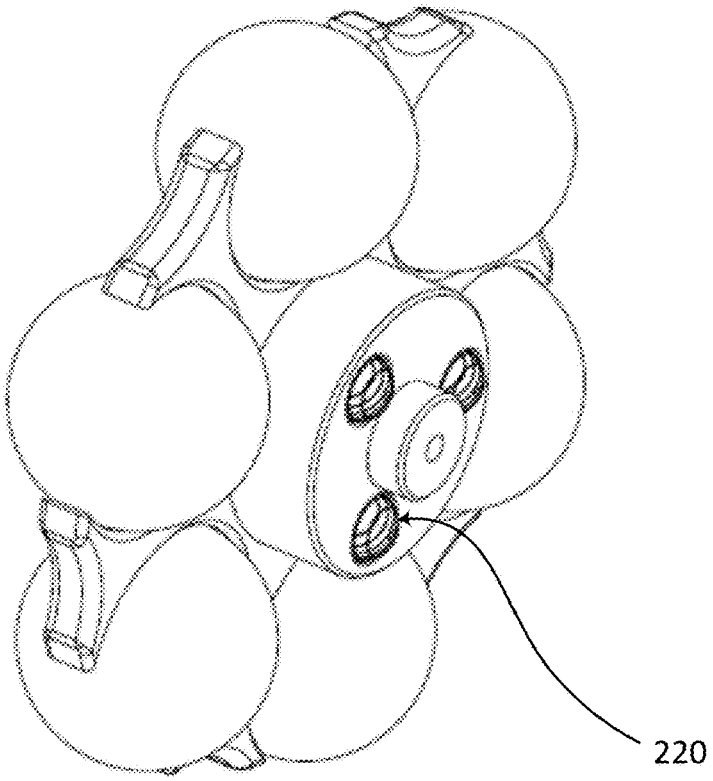
FIG. 3D illustrates another perspective view of an example cartridge wheel in accordance with some embodiments of the present disclosure, and in particular in accordance with the example embodiment shown in FIG. 1.

For example, taking the exemplary embodiment depicted in FIGS. 2-3D, cartridge wheel(s) 200 may be configured with three (or more) guiding elements 220 on each side of the cartridge wheel(s) 200. The position of each guiding element (e.g. ball plungers 22) may align with one or more of the six divots 107 formed in housing walls 108, 112 (e.g. here, aligning with every other divot 107). In operation, the ball plungers 220 may plunge into and retract out of the divots 107 of housing 100 as the cartridge wheel(s) 200 are rotated. The added forces at play as a result of this mechanism create the sensation for a user that that cartridge wheel 200 being rotated is snapping into or temporarily locking into the right position when the balls of ball plungers 200 plunge into one or more of the divot(s) 107. The foregoing is just one example of a guide element mechanism that may be employed in connection with the presently disclosed technology. One of ordinary skill in the art will recognize that other guide element mechanisms may be used instead of or in addition to the ball plungers described above (e.g. magnetic guide elements, guiding rings, and the like). Indeed, many different guide element mechanisms may be employed to aid in positioning/aligning cartridge wheel(s) 200 relative to housing 100 such that objects 300 may (upon an applied force from a dial 400 member) easily move in to, out of, and through channel(s) 204, and along gutter 116 from cartridge wheel to cartridge wheel.

Figure 4:
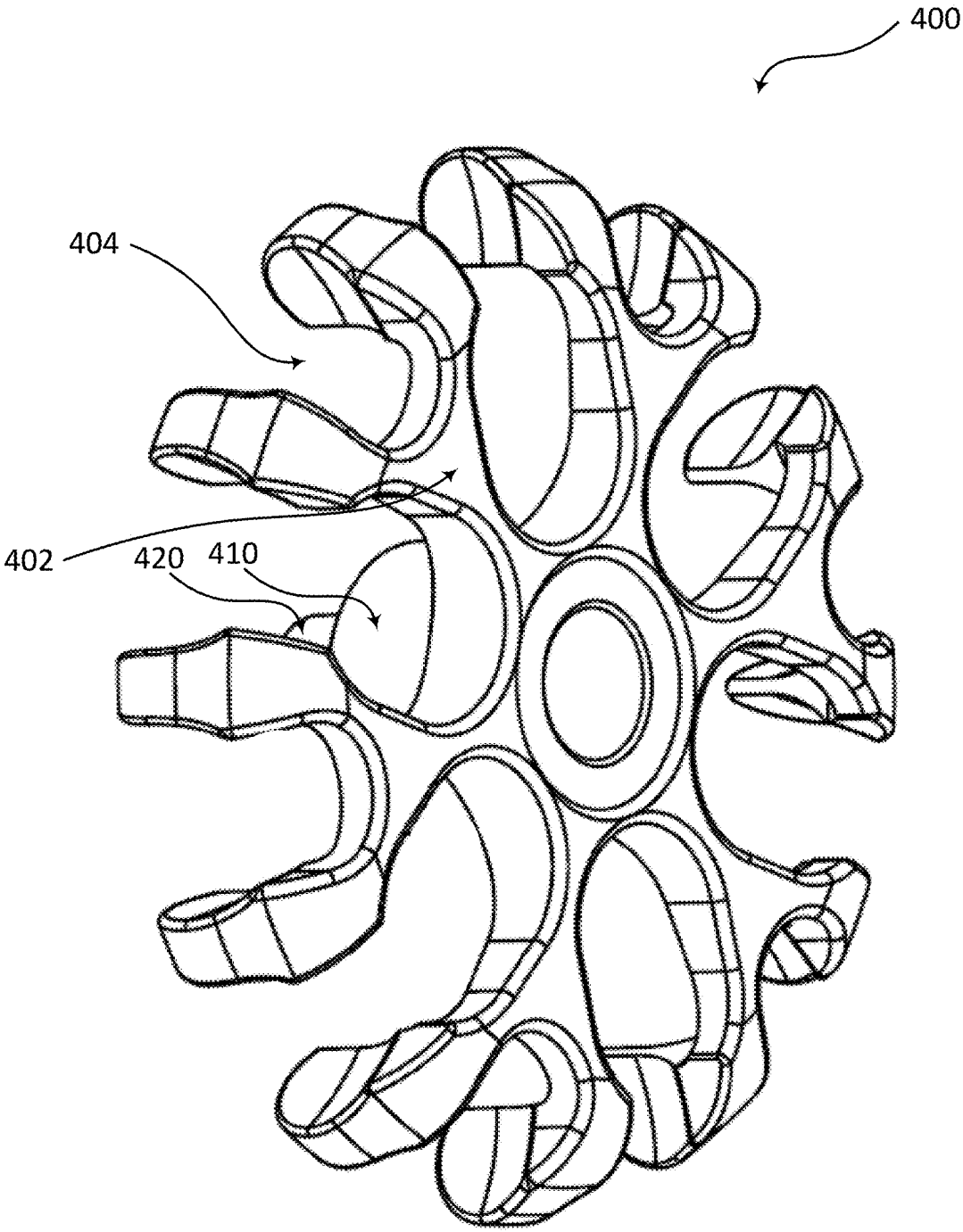
FIG. 4 illustrates a perspective view of an example object keyed dial in accordance with some embodiments of the present disclosure, and in particular in accordance with the example embodiment shown in FIG. 1.

FIG. 4 illustrates an exemplary object keyed dial 400 in accordance with some embodiments of the present disclosure, and in particular in accordance with the exemplary CPD 1000 shown in FIG. 1. For clarity and ease of understanding, the exemplary dial 400 illustrated in FIG. 1 is shown in FIG. 4 as separated from the remainder of the CPD 1000 assembly. As noted previously, dial 400 may be rotatably coupled with housing 100 of CPD 1000, and may structurally define one or more pocket regions within which one or more objects 300 may be held. As shown, dial 400 may be fashioned in a substantially wheel shaped design with a plurality of substantially Y-shaped spokes 402. The arms of the Y-shaped spokes 402 are formed such that they are uniformly bent or curled in a fashion that forms a three dimensional aperture 404 configured to receive and provide a partial pocket region(s) wherein an object 300 may be situated. The pocket region(s) 404 formed by Y-shaped spokes may be fashioned in a manner that permits an object 300 to pass through in a particular path (e.g. an arc path that substantially matches the arc path an object 300 follows when moving in rotation with the cartridge wheel(s) 200), but restricts movement in one or more other directions (e.g. restricts side to side movements outside the arc path). Dial 400 may further be configured with coupling feature(s) of any type (e.g. spacer 410, axle 420, and the like) to couple two or more dial(s) 400 on opposite sides of housing 100 together (as described below with reference to FIG. 5A).

Figure 5A:
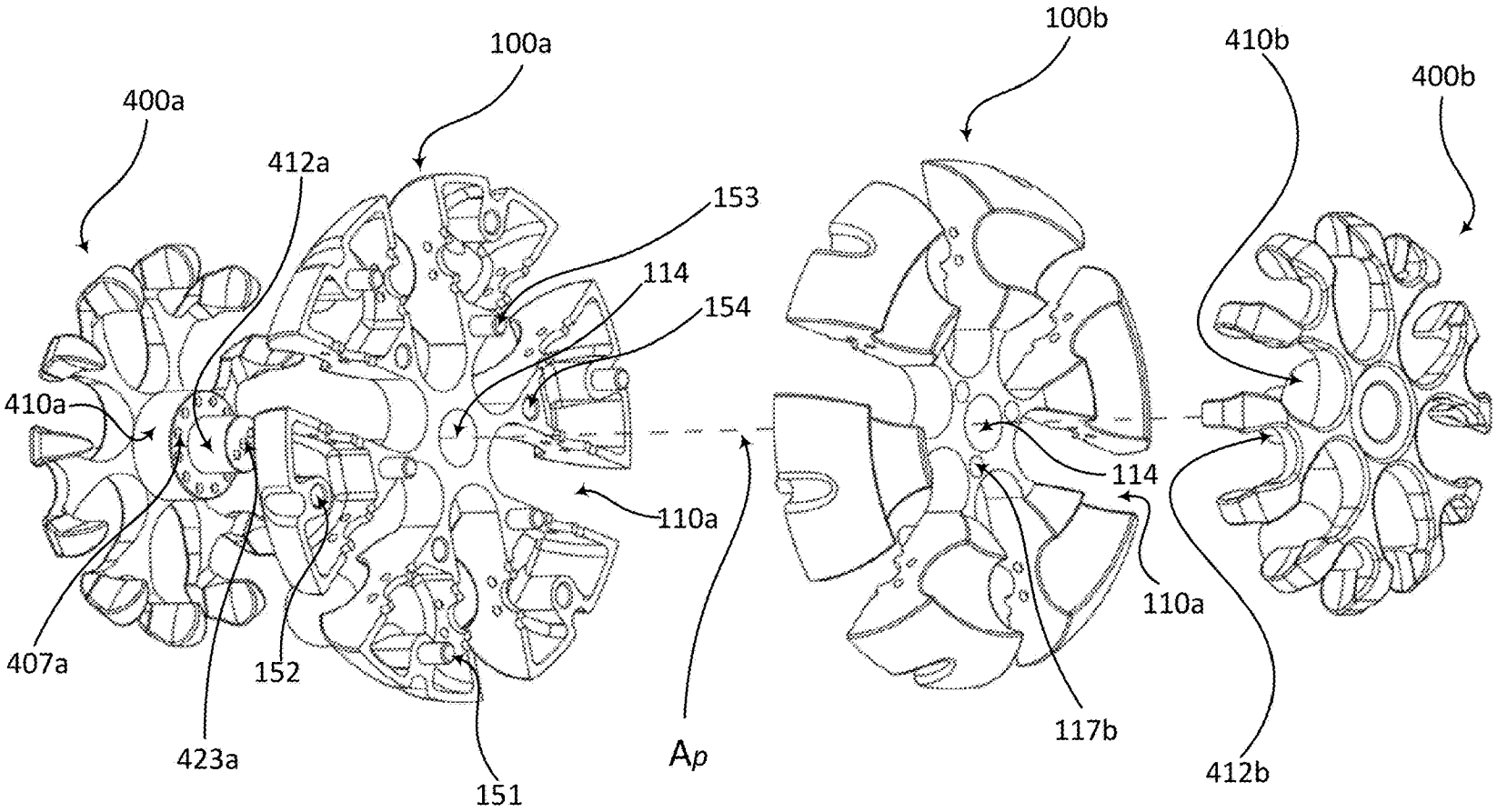
FIG. 5A illustrates a perspective view of an example housing component and two example dial components, in a disassembled configuration, in accordance with some embodiments of the present disclosure, and in particular in accordance with the example embodiment shown in FIG. 1.

As depicted, FIG. 5A illustrates housing component 100 and two dial components 400*a*, 400*b* in a disassembled configuration. The broken line, Ap, symbolically represents the primary axis about which the dials 400*a*, 400*b* may rotate, and which further represents the primary axis of housing 100. As shown, in some exemplary embodiments, a dial 400 may be situated on each side of housing 100. The first dial 400*a* may couple to the second dial 400*b* via a pass-through hole 114 in housing 100 (e.g. via fastening of axle 412*a* to axle 412*b*) such that the first dial 400*a* and the second dial 400*a* may rotate relative to housing 100. In some embodiments the first and second dials 400*a*, 400*b* may be coupled in a manner that requires them to rotate together (in sync). In other embodiments the first and second dials 400*a*, 400*b* may be coupled in a manner that allows each to rotate freely relative to the other (i.e. one may be moved without moving the other). And in still further embodiments, the first and second dials may be coupled together via a gear box (not shown) that requires the first and second dials 400*a*, 400*b* to move in opposition to one another (e.g. as one is moved clockwise, the other is moved counterclockwise. Indeed, any such variants/modifications may be employed in embodiments of the present technology.

The housing depicted in FIG. 5A is shown as two separate halves 100*a*, 100*b*, that can be joined together to form the housing 100 component. Such joining may occur via the use of any type of fastening mechanism including screws/bolts, adhesives, spot welds, snap-fit couplers, or any other fastening mechanism known in the art. For example, as depicted, each housing half 100*a*, 100*b* may be configured with one or more complementary coupling features (e.g. 151, 152, 153, 154) to join the first housing half 100*a* with the second housing half 100*b* in a secure manner. In other embodiments, housing 100 is not formed from two combined parts (e.g. a first housing half 100*a* and a second housing half 100*b*), but instead is formed as a single distinct piece (e.g. formed into a single unit from a mold). One of ordinary skill in the art will appreciate that the housing 100—and any of the other components discussed herein—may be formed as a single unit or made up of several smaller units that together may be discussed as a single unit. Any and all such configurations are contemplated by and intended to fall within the scope of the present disclosure.

Figure 5B:
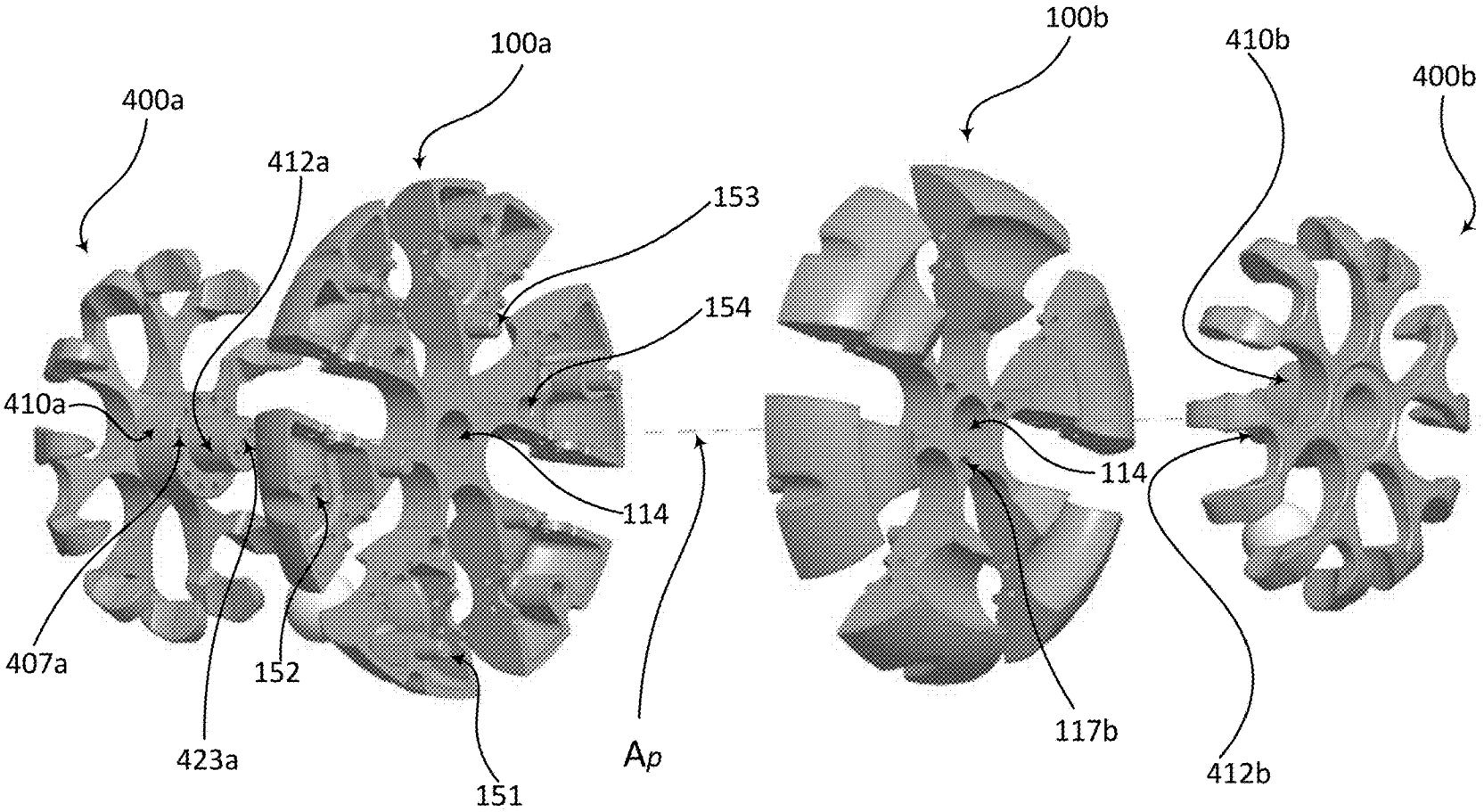
FIG. 5B illustrates a perspective view of an example housing component and two example dial components, in a disassembled configuration, in accordance with some embodiments of the present disclosure, and in particular in accordance with the example embodiment shown in FIG. 1.

FIG. 5B is a shaded view of the disassembled housing 100*a*, 100*b* and dial 400*a*, 400*b* components depicted in FIG. 5A, with like numerals representing like elements. The shaded view is provided to add visual clarity and understanding.

Referring to FIG. 5B, each housing 100 may be configured with one or more apertures (e.g. 117*a*, 117*b*) structured to accommodate (or form, in part) one or more guide elements (e.g. such as ball plungers, spring plungers, and the like). As noted previously, guide elements may engage with complementary features in dial(s) 400*a*, 400*b* (e.g. divot(s) 407*a*, 407*b*), to snap dial(s) 400*a*, 400*b* into one or more preferred positions in a path of rotation relative to housing 100. Often, there are a plurality of preferred positions the dial(s) 400*a*, 400*b* may take with respect to housing 100.

A plurality of guide elements and complementary features may be provided. For example, taking the exemplary embodiment depicted in FIG. 5A-5B, housing 100 may be configured with three apertures (e.g. 117*a*, 117*b*) to accommodate three guiding elements on each side of the housing 100. Each aperture's position may be configured to align with one or more divots 407*a*, 407*b* formed in spacer elements 410*a*, 410*b* of dials 400*a*, 400*b*. In operation, when a user applies a force to rotate dial 400*a* and/or 400*b*, the ball plungers (or any other guide elements employed) employed with housing 100 may move into and out of the divots 407 of dials 400*a* and/or 400*b* and create the sensation in a user's hands that that the dials 400*a* and 400*b* are slipping into the right position when the plungers plunge into a portion of the divots (similarly as described above in connection with cartridge wheel(s) 200).

As previously noted, dial(s) 400 may be configured with a spacer 410 that displaces the dial(s) slightly from the body of the housing 100. The dial(s) 400 may further be configured with an axle extension 412 configured to fit at least partially into pass-through hole 114. Although not required, in the embodiment depicted in FIG. 5B, each dial is configured with an axle extension (412*a*, 412*b*), each configured to join at approximately the center of the CPD 1000. Spacer elements 410*a*, 410*b* and axle elements 412*a*, 412*b* may be configured with a hole 423*a* passing therethrough to engage a fastener. A threaded fastener (e.g., a screw or a bolt) may be engaged through such hole 423*a* and serve to hold the CPD 100 assembly together as a unit. As described later with reference to FIG. 6A, in some instances a standard screw 650 may be used in the CPD 1000 assembly. As will be appreciated by one of ordinary skill in the art, any other coupling mechanism known in the art may be used to couple and/or assemble the various elements of CPD 1000, keeping them intact.

Figure 6A:
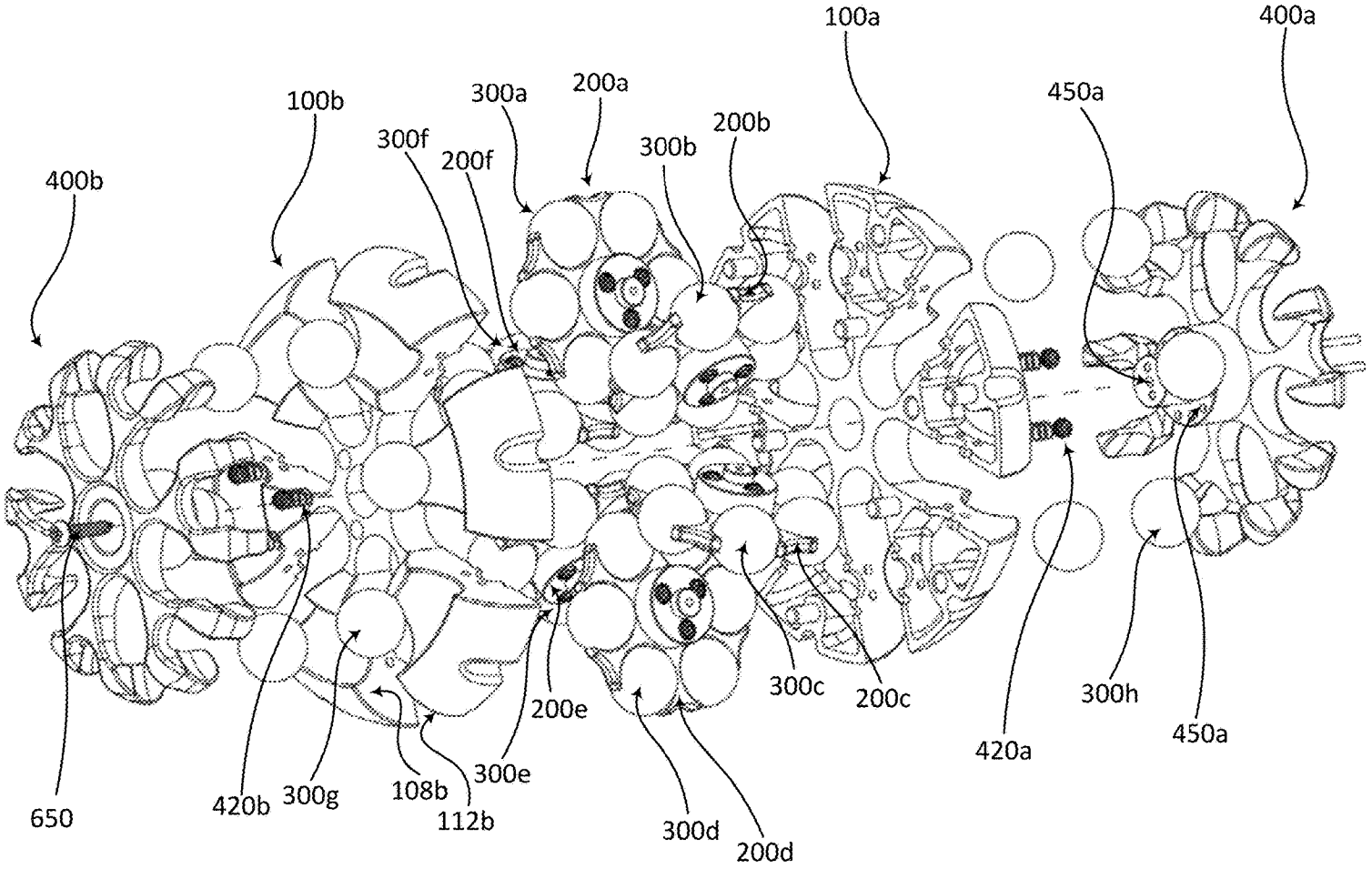
FIG. 6A illustrates a perspective view of the constrained puzzle device shown in FIG. 1, in a disassembled configuration that shows some internal features that cannot otherwise be seen in the assembled configuration, in accordance with some embodiments of the present disclosure.

FIG. 6A illustrates a perspective view of the CPD 1000 depicted in FIGS. 1-5B in a disassembled configuration that shows some internal features that cannot otherwise be seen when the CPD 1000 is assembled. For example, ball plunger guiding elements (e.g. 420*a*, 420*b*) are depicted outside the apertures (e.g. 117*a*, 117*b*) within which they are at least partially housed when CPD 1000 is assembled. Additionally, fastener 650 is depicted outside of the hole 423*a* it is at least partially situated within when CPD 1000 is assembled. Further as depicted, dial 400*a* and dial 400*b* are configured to be rotatably couplable with housing 100 (comprised of two halves: first housing half 100*a*, and second housing half 100*b*). Cartridge wheel(s) 200*a*-200*f* are configured to be rotatably coupled with housing 100 via one or more apertures or other coupling features of side wall(s) (e.g. side wall(s) 108, 112) of housing 100 that define the one or more slot(s) 110 of housing 100 within which cartridge wheel(s) 200 may be partially disposed. As shown, six objects 300 may be disposed within the six channels 204 of each of the six cartridge wheels 200*a*-*f* (for a total of 36 objects that may be held within the six cartridge wheels at any given time) coupled with and partially situated between side walls (e.g. side wall 108 and side wall 112) defining slots 110 of housing 100. Six more objects (e.g. object(s) 300*h*) are held between the structure of dial 400*a* and the housing half 100*a* (i.e. held within the pocket region(s) formed between the arms of Y-shaped spokes of dial 400*a* and a first crescent gutter 116 of the housing 100). And six more objects (e.g. object(s) 300*g*) are held between the structure of dial 400*b* and the housing half 100*b* (i.e. held within the pocket region(s) formed between the arms of Y-shaped spokes of dial 400*b* and a second crescent gutter 116 of the housing 100).

Figure 6B:
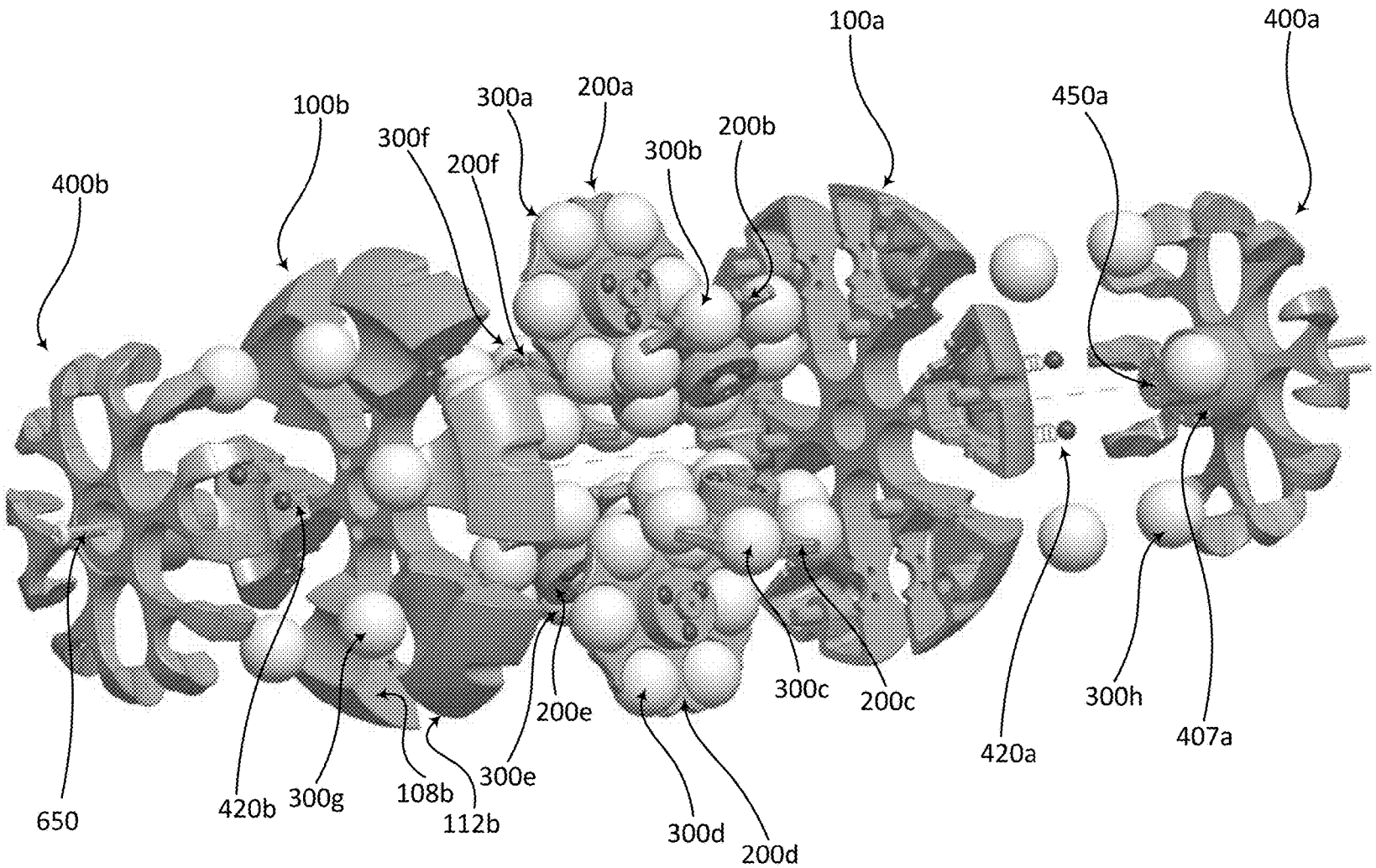
FIG. 6B illustrates a perspective view of the constrained puzzle device shown in FIG. 1, in a disassembled configuration that shows some internal features that cannot otherwise be seen in the assembled configuration, in accordance with some embodiments of the present disclosure.
Figure 7A:
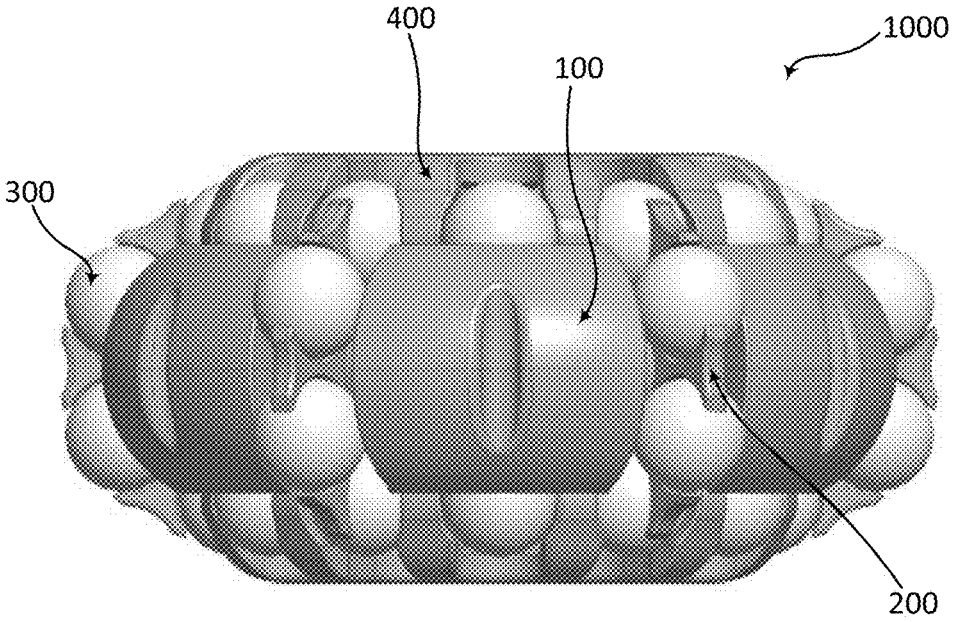
FIG. 7A is a side view of the constrained puzzle device depicted in FIG. 1.
Figure 7B:
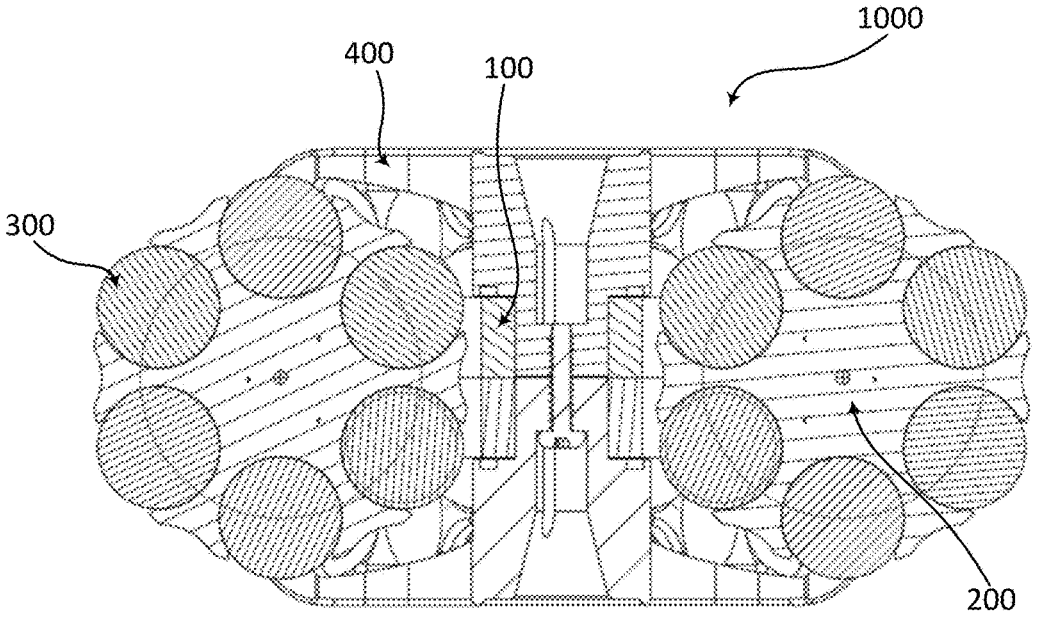
FIG. 7B is a cross-sectional side view of the constrained puzzle device depicted in FIG. 7.

FIG. 6B is a shaded view of the disassembled CPD 1000 depicted in FIG. 6A, with like numerals representing like elements. FIG. 7A is a shaded side view of the CPD 1000 depicted in FIG. 1, with like numerals representing like elements. FIG. 7B is a cross section side view of the CPD 1000 depicted in FIG. 7A. As depicted in FIG. 7B, the radius of curvature of the objects 300 may in some instances be substantially the same as (though slightly less than) the radius of curvature of channel(s) 204 of the cartridge wheel(s) 200. As may be seen from FIG. 7 in view of FIGS. 1-2, the side walls 203, 205 of spokes 202 of cartridge wheel(s) form a channel that may restrict the movement of an object 300 fitted therein in at least one direction. As shown, such channel walls (e.g., 203, 205) may in some embodiments extend slightly more than a halfway (i.e. more than to form merely a semicircle) but slightly less than to form a full circle. Thereby, the channel(s) 204 may restrict movement of object(s) 300 in the outward radial direction, but still allow space (e.g. the gap in the arc) for a portion of dial 400's arms to move therethrough when rotated. This operation may occur when the cartridge wheel(s) 200 are in a preferred position, e.g., a snapped-in position, as described previously.

In this fashion, the cartridge wheel(s) 200, the dial(s) 400, and the object(s) 300 may work together in a manner that—when positioned properly relative to one another—the dial(s) 400 may be rotated relative to the housing 100 and thereby move object(s) 300 (along the housing gutter) from one cartridge wheel 200 to another (in either or both directions), and cartridge wheel(s) 200 may be rotated in a manner that moves channel(s) 204 into alignment with housing gutter 116 such that objects 300 are held in channel(s) 200 may be moved by dial 400. When an object 300 is still within the channel of the cartridge wheel 200 but set in a position where it may be moved into or out of the channel by dial 400 (i.e. the channel and the object are aligned with the profile of the housing gutter 116), this is sometimes referred to as the object being in the "chamber." In the exemplary embodiments depicted throughout FIGS. 1-6B, for each cartridge wheel 200 in the CPD 1000 there may be two objects 300 in the chamber at a time. In other embodiments, dial(s) 400 and cartridge wheel(s) may be configured in a combination with housing 100 such that more than two objects 300 are chambered at a time (i.e. when a dial 400 is moved, it may move more than one object at a time from each cartridge wheel 200). Although the figures discussed in this disclosure refer to a particular embodiment (for purposes of clarity and discussion), it should be understood that any and all variants are intended to fall within the scope of the present disclosure. One of ordinary skill in the art will appreciate that the profile, size, shape, quantity, etc. of any one or more of the housing 100, cartridge wheel(s) 200, object(s) 300, and dial(s) 400 may be modified to enhance or reduce the complexity of constrained puzzle devices without departing from the scope of this disclosure.

Figure 8A:
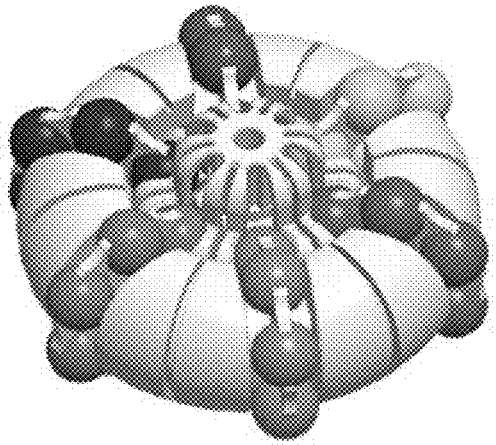
FIG. 8A illustrates a perspective view of another example constrained puzzle device in accordance with one or more embodiments of the present disclosure.
Figure 8B:
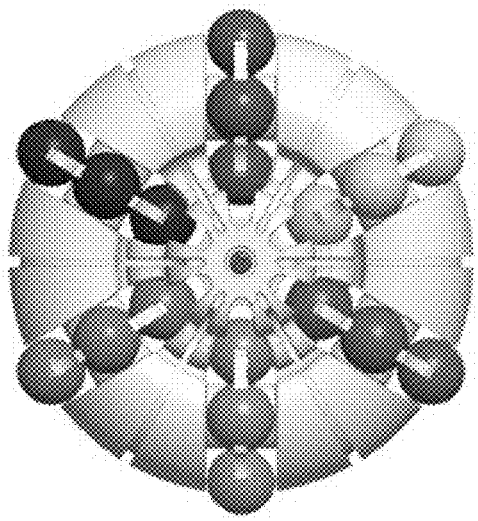
FIG. 8B illustrates a top view of the constrained puzzle device shown in FIG. 8A, in accordance with one or more embodiments of the present disclosure.
Figure 8C:
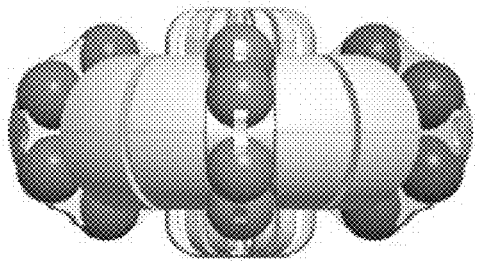
FIG. 8C illustrates a side view of the constrained puzzle device shown in FIG. 8A, in accordance with one or more embodiments of the present disclosure.

For example, FIGS. 8A-8C depict an embodiment with a housing that takes on more of a donut shape, the dial formed with a shelf-styled configuration where spokes of the dial are situated deeper within the housing and only hold objects between the spokes (not both within and between each spoke as does the embodiment depicted in FIG. 1). In operation, a user may grip the knob of one or more of the dial(s) and apply a rotating force such that the objects in the chamber may be moved. In some embodiments, there is only a single dial and a single gutter configured to operate with the dial to move the objects. As a variant of the embodiment depicted in FIGS. 8A-8C, when a user applies a rotating force to either knob extending outward at the sides of the CPD, both knobs move and the entire dial is moved as a single unit.

Figure 9A:
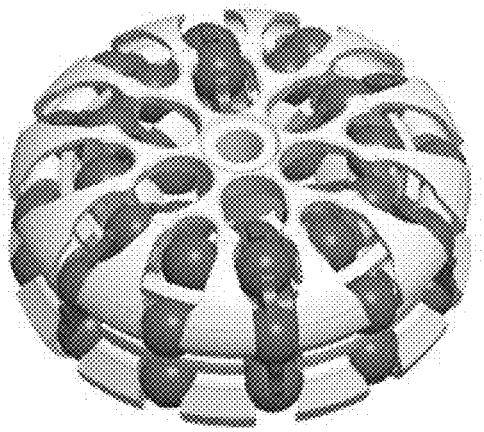
FIG. 9A illustrates a perspective view of another example constrained puzzle device in accordance with one or more embodiments of the present disclosure.
Figure 9B:
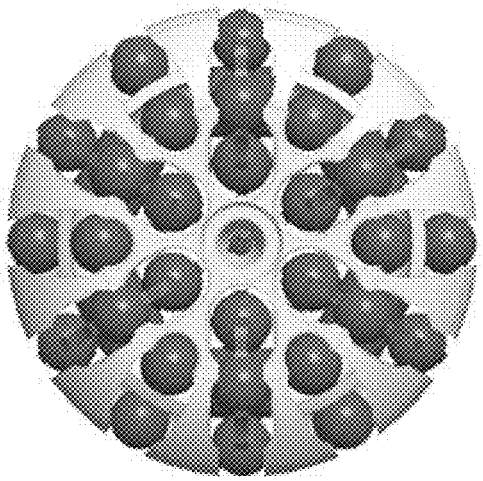
FIG. 9B illustrates a top view of the constrained puzzle device shown in FIG. 8A, in accordance with one or more embodiments of the present disclosure.
Figure 9C:
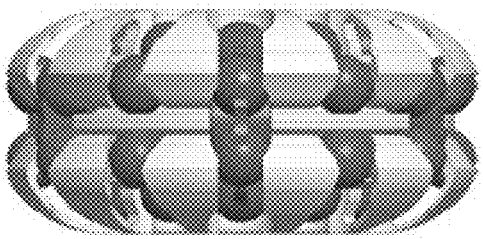
FIG. 9C illustrates a side view of the constrained puzzle device shown in FIG. 8A, in accordance with one or more embodiments of the present disclosure.

In another example variation falling within the scope of the present disclosure, as depicted in FIGS. 9A-9C, some embodiments may include dial components that overlay the housing of the CPD and be configured in such a manner that the each dial may move multiple objects into and out of any given cartridge wheel at a time. Although not shown separately, the housing of the embodiment depicted in FIGS. 9A-9C may be a radially fluted donut shaped component. That is, the housing may contain a plurality of fluted regions that operate as the gutter of the CPD. In the particular embodiment depicted, the internal housing contains six gutters, three accessible to and fitted with the pocket regions of a first dial, and three accessible to and fitted with the pocket regions of a second dial. Thus, in operation, when a user applies a rotating force to one of the dials (when the cartridge wheels are in a preferred position), the moving dial may move three objects at a time from each cartridge wheel into and out of a neighboring cartridge wheel. As one of ordinary skill in the art will appreciate, after consideration of the foregoing examples and variants, a dial may be modified to move any number of objects at a time, a cartridge wheel may be configured to hold any number of objects at a time, a housing component may be substantially internal or substantially external, and may include any number of flutes/gutters along which an object may be moved, and any one of the foregoing parts may be modified such that any number of objects are located within a chambered region at a given time.

One of ordinary skill in the art will recognize that a mechanical device, structure, or component may be formed as a single unit, or formed from a plurality of sub-devices, sub-structures, or sub-components. For example, housing 100, although discussed as a single component, may in fact be made from several components joined together (e.g. welded, adhered, snap-fitted, or otherwise fastened) to form what is memorialized as a distinct component for purposes of discussion. Such is the case with the present disclosure, and it is intended that the present disclosure extend to any and all such variations. Any one or more of the components discussed herein (e.g. housing 100, cartridge wheel 200, object 300, and dial 400, etc.) may be formed as a single unit of material (e.g. a molded component), or may be formed from two or more components that are joined together to define the part. For example, as depicted in FIG. 2, housing 100 may be formed from two symmetric halves, 102, 104 that are snap fitted together to create the housing 100 unit itself.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent component/element names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the elements or functionality described or claimed as part of the component are all configured in a common package. Indeed, any or all of the various elements of a component, including structural elements, can be combined in a single package or separately maintained and can further be distributed in multiple groupings or packages.

Additionally, the various embodiments set forth herein are described in terms of exemplary diagrams and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

We claim:

1. A constrained puzzle device, comprising:

a housing, the housing configured with:

a first crescent gutter along an annular path of a first side of the housing, and a second crescent gutter along an annular path of a second side of the housing, the second side of the housing opposite the first side of the housing, the first crescent gutter and the second crescent gutter having substantially equal radii of curvature;

multiple slots, the slots providing a radially inward openings from an outer edge of the housing;

multiple cartridge wheels, the cartridge wheels at least partially disposed within the slots and rotatably coupled to the housing, the cartridge wheels configured with:

multiple channels, the channels having substantially equal radii of curvature;

a first dial rotatably coupled with the housing, the first dial configured with one or more members extending at least partially over the first crescent gutter;

a second dial rotatably coupled with the housing, the second dial configured with one or more members extending at least partially over the second crescent gutter;

multiple puzzle objects, at least one of the multiple puzzle objects disposed at least partially within one or more of: a channel of a cartridge wheel, a slot of the housing, the first crescent gutter of the housing, and the second crescent gutter of the housing.

2. The constrained puzzle device of claim 1, wherein when the cartridge wheels are aligned in a first preferred position, one or more puzzle objects may be movable out of one or more cartridge wheel channels and along the path of the first crescent gutter as the first dial is moved.

3. The constrained puzzle device of claim 2, wherein when the cartridge wheels are aligned in the first preferred position, one or more puzzle objects may be movable out of one or more cartridge wheel channels and along the path of the second crescent gutter as the second dial is moved.

4. The constrained puzzle device of claim 3, wherein the first dial is rotatable independent of any rotation of the second dial.

5. The constrained puzzle device of claim 1, wherein the multiple puzzle objects are spherical.

6. The constrained puzzle device of claim 5, wherein the radius of the puzzle objects is less than or equal to the radii of curvature of the first crescent gutter and the second crescent gutter.

7. The constrained puzzle device of claim 1, wherein one or more of the housing and the cartridge wheels include guide elements to move the cartridge wheels into one of multiple preferred positions relative to the housing.

8. The constrained puzzle device of claim 1, wherein one or more of the housing and the first dial include guide elements to move the first dial into one of multiple preferred positions relative to the housing.

9. The constrained puzzle device of claim 1, wherein one or more of the housing and the second dial include guide elements to move the second dial into one of multiple preferred positions relative to the housing.

10. The constrained puzzle device of claim 1, wherein the multiple puzzle objects are labeled with numbers.

11. The constrained puzzle device of claim 1, wherein the multiple puzzle objects are not all the same color.

* * * * *